US005210976A

United States Patent [19]

Cripps

[11] Patent Number: 5,210,976

[45] Date of Patent: May 18, 1993

[54] WINDOW BALANCE ASSEMBLY

[75] Inventor: Ken Cripps, Bramalca, Canada

[73] Assignee: Vinyl Concepts Incorporated, Woodbridge, Canada

[21] Appl. No.: 904,678

[22] Filed: Jun. 26, 1992

Related U.S. Application Data

[63] Continuation of Ser. No. 745,728, Aug. 16, 1991, abandoned.

[51] Int. Cl.[5] ..... E05D 15/22

[52] U.S. Cl. ..... 49/181; 49/445

[58] Field of Search ..... 49/181, 176, 445, 446, 49/447, 453

[56] References Cited

U.S. PATENT DOCUMENTS

| | | | |
|---|---|---|---|
| 3,012,292 | 12/1961 | Brengman | 49/181 X |
| 3,135,014 | 6/1964 | Martin | 49/181 X |
| 3,195,174 | 7/1965 | Nobes | 49/181 X |
| 3,482,354 | 12/1969 | Trout | 49/181 |
| 4,079,549 | 3/1978 | Wood | 49/181 |
| 4,590,708 | 5/1986 | Campodonico | 49/181 |
| 4,718,194 | 1/1988 | FitzGibbon et al. | 49/181 |
| 4,779,380 | 10/1988 | Westfall | 49/445 X |
| 4,914,861 | 4/1990 | May | 49/181 |

*Primary Examiner*—Peter M. Cuomo
*Assistant Examiner*—Jerry Redman

[57] ABSTRACT

A sash window balance assembly of the present invention is fitted in a window frame for guiding movement of a sash window. The assembly includes a coil spring secured to a flexible shoe having an opening through the shoe and a cam rotatably fitted in the opening. The opening has different interior diameter span regions including a small span region bordered by a larger span region. The cam has different exterior diameter span regions including a small span region bordered by a larger span region. The shoe has an open side for flexing of the shoe between a release position when the small span regions of the shoe and the cam align with one another and a brake position when the small span regions of the shoe and the cam are out of alignment with one another. The shoe further includes exterior brake pads operable in the brake position with the brake pads being tapered inwardly along and towards the open side of the shoe. When the shoe flexes at its open side, the tapered brake pads have a flush engagement with the window frame in which the shoe is mounted.

3 Claims, 4 Drawing Sheets

WINDOW BALANCE ASSEMBLY

This is a continuation application of application Ser. No. 07/745,728 filed on Aug. 16, 1991, now abandoned.

FIELD OF THE INVENTION

The present invention relates to a window balance assembly which is used in a sash window.

BACKGROUND OF THE INVENTION

Sash windows are becoming even more popular. In a relatively standard or conventional sash window set up, two sash window members are located in side by side window channels of a window frame. The sash window members move up and down relative to one another. The weight of each sash window member is effectively counterbalanced by some type of a balancing mechanism. The outer sash window member can be tilted outwardly for cleaning the outside of both of the window members.

Coil springs are now being used as sash balances. These coil springs are supported at one end within the window jamb or frame and secured at the other end to a balance shoe which travels up and down with the sash window. As the coil spring is unwound, it counterbalances the weight of the window.

It is known to provide sash balance shoes which include rotatable cams to allow outward tilting of a sash window. When the window is tilted outwardly the balance shoe moves to a braking positions to prevent up and down movement of the window holding it in a fixed position for cleaning and the like.

Different examples of balance shoes are shown in U.S. Pat. Nos. 3,789,549, 4,068,406, 4,079,549, 4,271,631, 4,363,190, 4,590,708, 4,610,108, 4,683,676 and 4,718,194. However, all of the structures shown in the above patents are relatively complex and include numerous different working parts subject to wear and premature breakdown. Furthermore, many balance or brake shoes produce relatively inaffective braking action such that the sash windows themselves are then subject to damage.

As a further drawback, the balance shoes of the prior art structures are not constructed to take into consideration possible disconformities in the window jamb which might cause a binding action on the shoe which then makes it harder to move the window.

SUMMARY OF THE PRESENT INVENTION

The present invention provides a sash window balance assembly specifically designed to overcome the problems noted above. In particular, the sash window balance assembly of the present invention comprises spring means for counterbalancing weight of the sash window, a flexible shoe to which the spring means is attached, the shoe having an opening therethrough and a cam rotatably fitted in the opening. The opening in the shoe has regions of different diameters or spans including a small span region bordered by a larger span region. The cam has regions of different exterior diameters including a small span region bordered by a larger span region. The shoe has an open side for flexing between a release position when the small span regions of the shoe and the cam align with one another and a brake position when the small span regions of the shoe and the cam are out of aligment with one another.

The shoe includes exterior brake pads and those brake pads are tapered inwardly along and towards the open side of the shoe. This arrangement in which the brake pads are tapered inwardly towards the open side of the shoe produce a full flush contact between the brake pads and the window frame or jamb when the shoe is in a brake position thereby providing a very positive locking action of the shoe in the window jamb.

According to a preferred aspect of the present invention, the cam and shoe fit with one another when the shoe is in a release position such that the cam will not fall out of the shoe while at the same time, the shoe can be collapsed inwardly to the extent that it closes upon itself around the cam to allow not only outward but also inward flexing of the shoe to ride over any small bumps or the like in the window jamb enhancing sliding action of the window.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
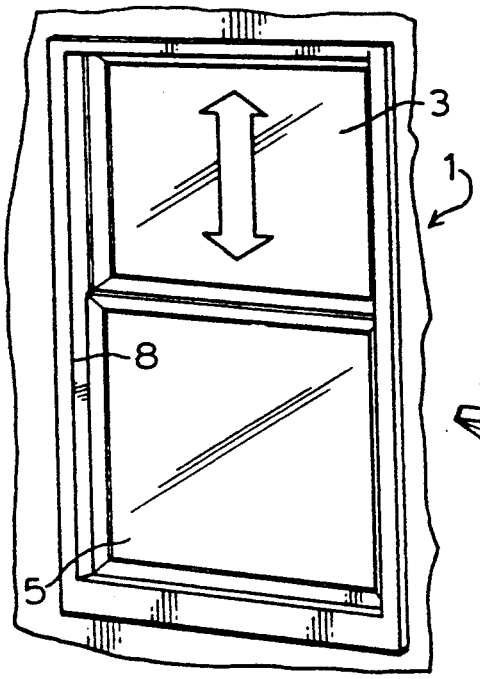
FIG. 1 is a perspective view of a sash window with upper and lower window members both in their closed positions.
Figure 2:
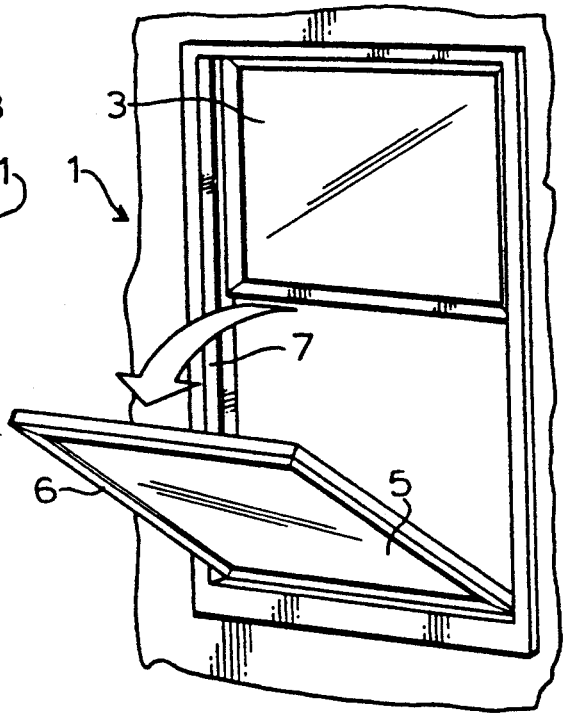
FIG. 2 is a view similar to FIG. 1 showing the outward tilting of the bottom window member.

FIG. 1 shows a sash window assembly generally indicated at 1. This overall assembly comprises an upper window member 3 and a lower window member 5. As shown in FIG. 2 of the drawings, the lower window member 5 is titlable outwardly of the window assembly.

Figure 3:
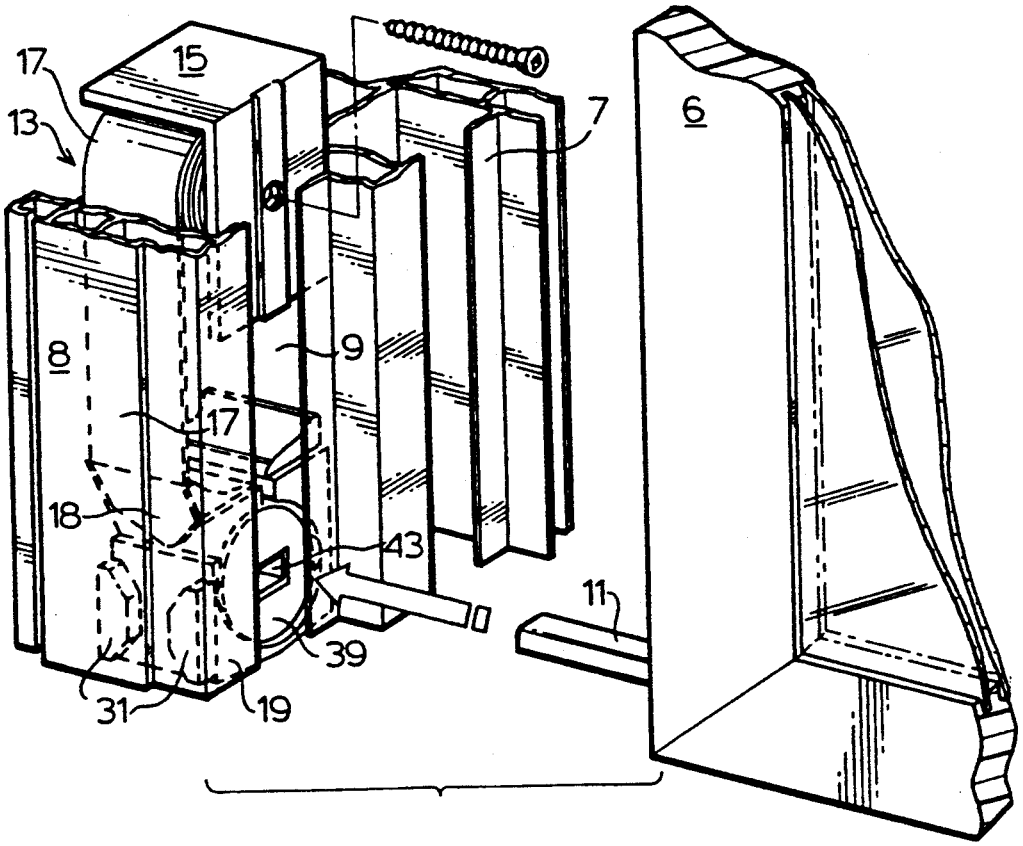
FIG. 3 is an enlarged perspective view of a window balance assembly fitted into the window jamb and to be connected to the sash window of FIG. 2.

Both of the window members are slideable vertically within the window assembly. FIG. 3 shows a section of the window frame or jamb in which the two window members are mounted. This jamb comprises a double frame including an outside frame portion 8 and an inside frame portion 7. This allows the two window members 3 and 5 to move vertically relative to one another.

Each of the window members includes a balance assembly for offsetting or counterbalancing weight of that particular window member. This means that neither window member will fall within its respective jamb down onto the lower window sill. At the same time, the strength of the balance assembly is not sufficient to automatically pull either window member to an up position but rather to simply hold any position to which the window is set.

Figure 4:
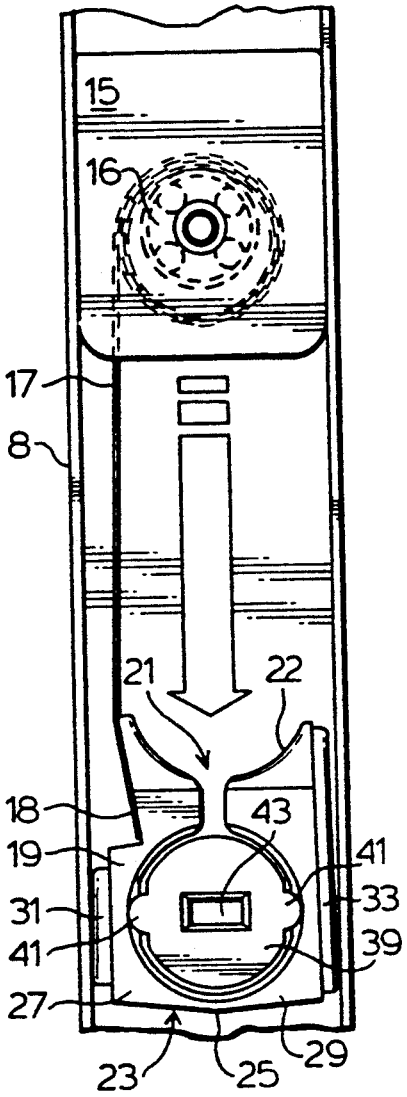
FIGS. 4 and 5 are side views showing up and down window movement as counterbalanced by the window balance assembly of FIG. 3.
Figure 5:
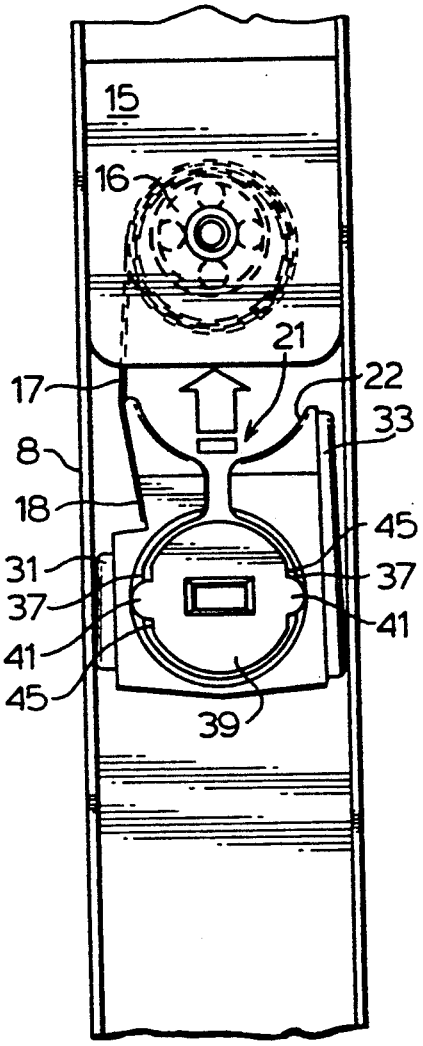

FIG. 3 shows a window balance assembly generally indicated at 13 for use in offsetting or counterbalancing the weight of one of the window members and in particular window member 5. The window balance assembly as shown is mounted directly within frame portion 8 of the window jamb. It includes a support portion 15 which is set at a fixed height within the jamb, i.e. frame portion 15 does not move. Mounted within the frame portion 15 is a rotatable spindle as best seen in FIGS. 4 and 5 of the drawings. Fitted around spindle 16 is a coil spring 17. Spindle 16 allows winding and unwinding of the coil spring relative to frame portion 15.

Spring 17 is secured at its lower free end 18 to a balance shoe 19. This balance shoe includes an upper rounded side 22 which is opened, as indicated at 21, to allow flexing of the shoe to be described later in detail. The rounded configuration of the upper side of the balance shoe enables the shoe to fit directly against coil spring 17 in its coiled configuration to ease the securing of the coil spring to the balance shoe, i.e. the spring can be secured with little or no unwinding of and tension on the spring.

The bottom side of the shoe generally indicated at 23 includes a center point 25 with arm-like extensions 27 and 29 to either side of the center point of the bottom of the shoe. The bottom side to be contrasted to the top side of the shoe is completely closed and provides the fulcrum for flexing or bending of the shoe between a release and a brake position, again to be described later in detail.

Provided at one of the outer sides of the balance shoe is a first brake surface 31. As will be seen in FIG. 3 of the drawings, brake surface 31 is in fact formed by two identical brake pads slightly separated from one another on the one side of the shoe. The other side of the shoe is provided with a taller single brake pad 33. The brake pads 31 are of a reduced height relative to brake pad 33 simply to allow for the securing of the lower end of the coil spring to the brake shoe.

One of the key features of the present invention is that each of the brake pads 31 and 33 has an upward inward taper towards the open upper end of the shoe. This is best seen in FIGS. 4 and 5 of the drawings where the lower edge of each of the brake shoe is either very close to or actually engages the inner walls of the window jamb when the brake shoe is in a release position. However, the upper end of each of the brake shoes when in the release position is clearly gapped from and out of contact with the window jamb. This, upward inward tapering of the brake shoes can be achieved by either an actual downward thickening of the brake pads themselves or by tapering the brake shoe such that the pads while being of a consistent thickness are simply directed upward and slightly inwardly with the brake shoe.

Figure 7:
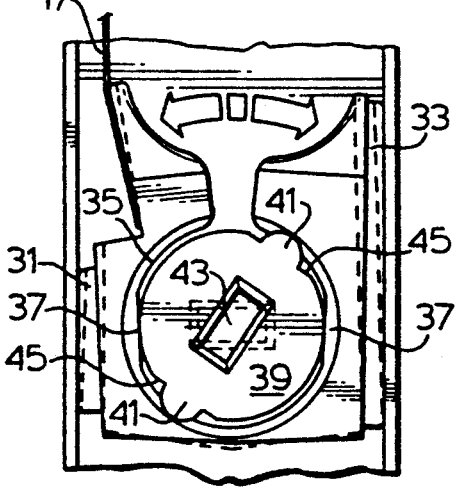
FIG. 7 is a side view showing operation of the tapered brake pads from the balance shoe of the assembly shown in FIG. 4.
Figure 8:
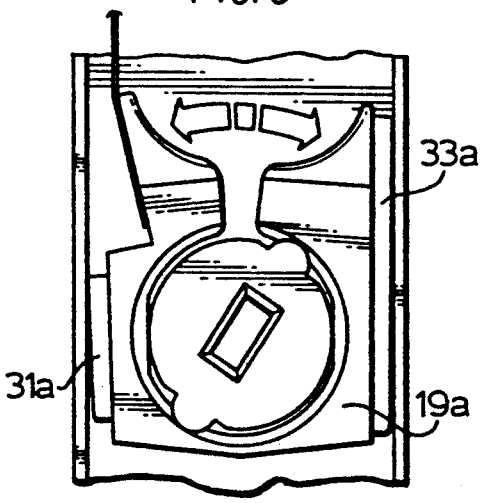
FIG. 8 shows a shoe modified from that shown in FIG. 7 and including straight brake pads rather than the tapered brake pads.

FIG. 7 of the drawings, shows the brake shoe in a brake position to be described later in detail. However, at this point it is to be clearly noted that each of the brake pads 31 and 33, because of their upward inward tapering in the release position, is in contact along the entirety of its outer brake surface when in the brake position because of the upward inward tapering of each of the brake pads. This is to be contrasted to the FIG. 8 set up which shows a brake shoe generally indicated at 19*a* and having brake pads 31*a* and 33*a*. Each of these brake pads is constructed such that they extend substantially vertically without any taper when the brake shoe is in the release position. FIG. 8 shows brake shoe 19*a* in a brake position where the two brake pads 31*a* and 33*a*, because of their straight up non-tapered design, only have a very minimal contact at their upper edges with the window jamb with much of the brake pad being out of braking contact with the window jamb. This undesireable condition occurs because the brake show only flexes outwardly at its upper end and does not have any outward flexing at its lower end.

Figure 6:
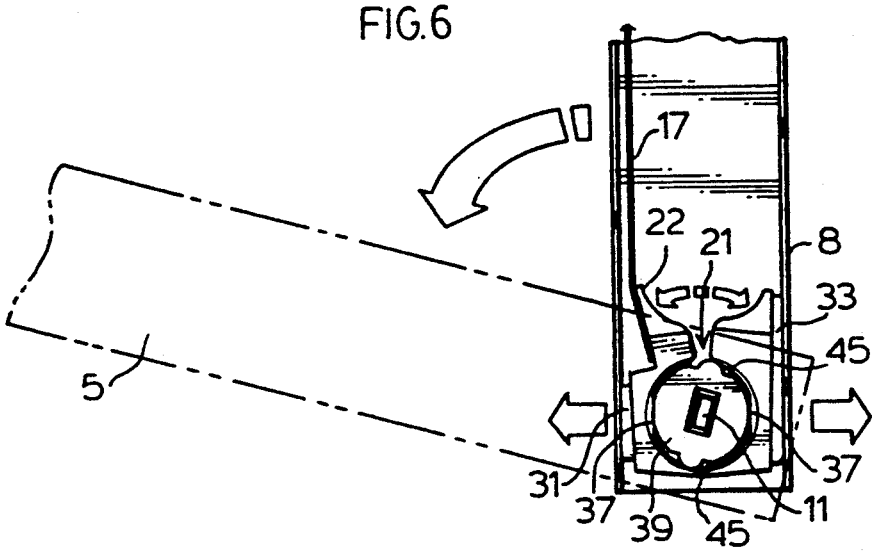
FIG. 6 is a side view of the window balance assembly showing outward tilting of the window member as seen in FIG. 2 of the drawings.

The flexing of the brake shoe to its brake position is caused by outward tilting of the window as shown in FIG. 6 of the drawings. As shown in FIG. 3*a* post 11 which is secured in the window frame 6 extends through the open channel region 9 of the window jamb 8 and into opening 43 of cam 39. This provides the contact between the window and the shoe and causes the shoe to move up and down in the window jamb with the window. The coil spring unwinds as the shoe is moved downwardly with and counterbalances weight of the window. The upper end of the window, which is frictionally engaged within the window jamb by releaseable pins or the like (not shown) can be popped out of the window jamb by simply releasing the pins. However, brake or balance shoe 39 is trapped and holds the bottom end of the window in the jamb. The non-rotational engagement between pin 11 and cam 39 causes the cam to rotate when tilting the window and which moves the shoe to the brake position for holding the height of the window as shown in FIG. 6 of the drawings.

In order to more fully understand operation of the cam and the brake shoe, the structure of the cam is now described in more detail. In particular, cam 39 includes small ears or lugs 41 which simply stop the cam from sliding completely through the interior opening within the brake shoe. This interior opening of the brake shoe has different interior diameter regions including a smaller interior diameter region where the generally circular shape of the opening is interrupted by flats 37 to either side of the brake shoe. The interior diameter of the opening between the flats 37 is of a decreased diameter relative to the diameter across the rest of the opening.

Cam 39 has an exterior diameter of various different diameter regions. The cam has a truncated elliptical configuration and includes flats 45 to either side of the cam. The diameter across the cam at the flats is less than the diameter across the cam at all points between the flats.

Shoe 19 is in the release position when the flats 45 on cam 39 align with the flats 37 of the interior opening of shoe 19. This occurs when the window is in an upright position moveable vertically within the window jamb. When the window is tilted outwardly, the cam which rotates with the tilting of the window is moved to a position such that the flats on both the cam and the shoe are out of alignment with one another as shown for example in FIGS. 14 and 15 of the drawings. This causes the larger diameter elliptical surface on the cam to engage the flats on the shoe with a resultant outward flexing or opening of the shoe. All of this outward opening occurs at the upper end of the shoe and pushes the brake pads 31 and 33 into contact with the window jam as earlier described.

Figure 9:
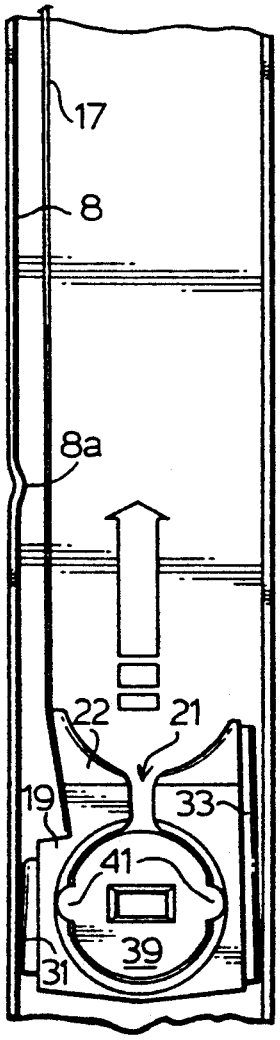
FIGS. 9 through 11 show upward movement of the balance shoe of FIG. 2 along the window jamb where the window jamb includes an inward bump.
Figure 10:
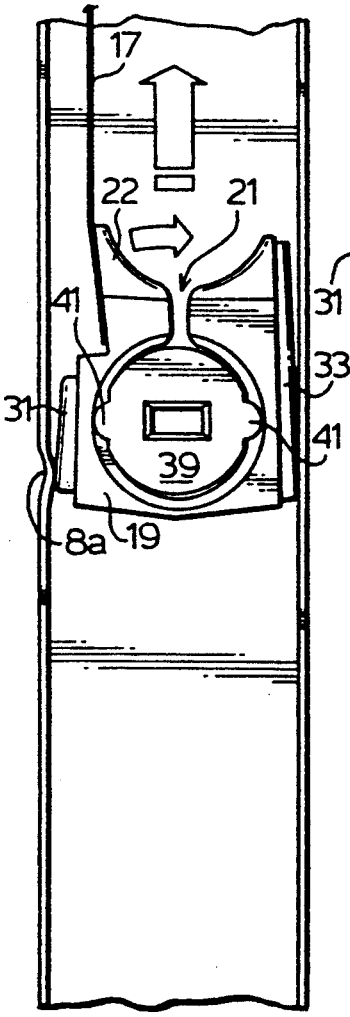
Figure 11:
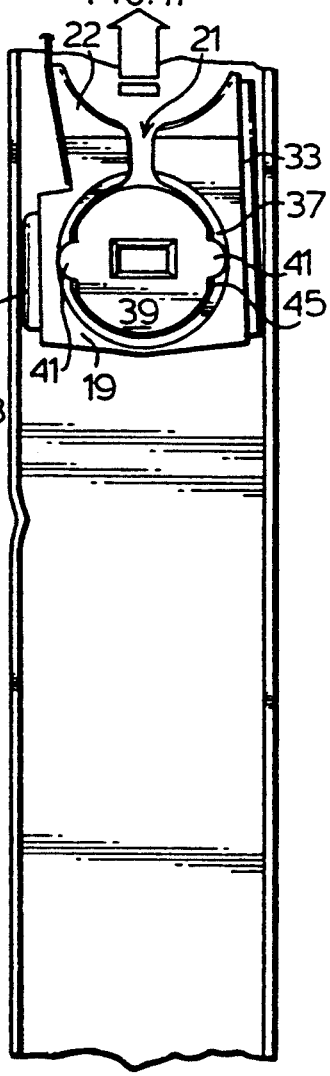
Figure 12:
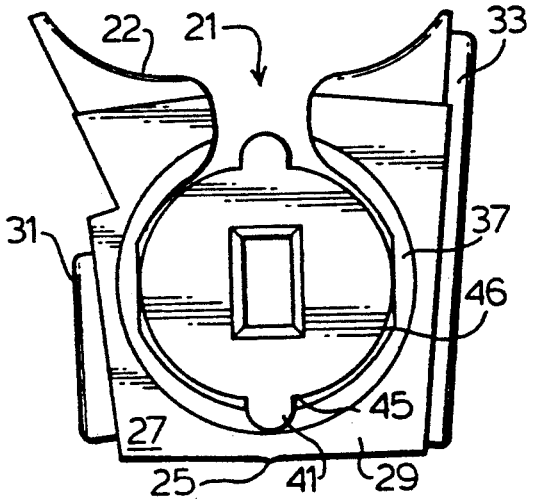
FIG. 12 is an enlarged side view showing the shoe from the assembly of FIG. 2 in an outward braking position.
Figure 13:
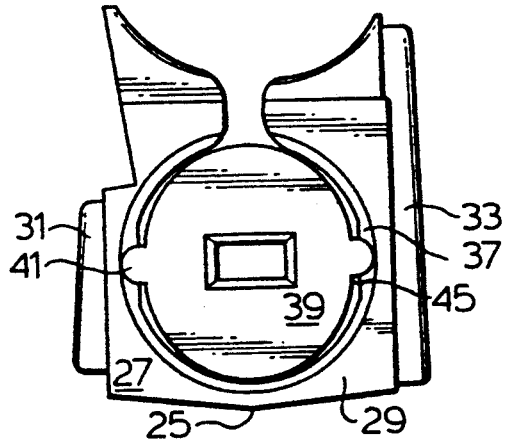
FIG. 13 is a side view showing the shoe from the assembly of FIG. 2 in a release position.

FIGS. 12 and 13 of the drawings show shoe 19 in its two most extreme positions, i.e. FIG. 12 shows the shoe in a fully outwardly flexed position while FIG. 13 shows the shoe in its fully inwardly collapsed position. The normal release position of the shoe is shown for example in FIGS. 9 through 11 of the drawings. Here it should be noted that in FIG. 13, the shoe can be collapsed to the extent that the top opening 21 completely closes around the cam. This is achieved because there is sufficient tolerance between the cam and the shoe in the release position. However, this has not the normal unflexed position of the shoe which, without any additional bias remains slightly spread or open at its upper end as shown in FIGS. 9 and 11 of the drawings. Also, even though there is a tolerance between the cam and the shoe, the cam will not slide completely through the shoe because of the overlap provided by lugs 41 on the cam as earlier described.

The reason for providing a tolerance between the cam and the shoe which allows inward flexing of the shoe is to accommodate problem areas in the form of bumps or protrusions inwardly of the window jamb. This is best seen in FIG. 10 of the drawings which shows the shoe sliding upwardly and passing over a bum 8*a* to the inside of the window jamb. Brake pad 31 contacts the bump but rather than binding on the jamb, the shoe flexes inwardly to allow the brake pad to slide over the bump. Also of assistance in clearing the bump are the rounded upper and lower edges of the brake pad, as well as the camming action of the pad due to its upward inward tapering as it slides upwardly over the bump. Once the pad clears the bump, the shoe because of its normal flex characteristics rebounds from the FIG. 9 back to the FIG. 11 position. As will be seen in the FIG. 10 collapsed position of the shoe, the gap at 21 although not completely closed is less than the gap at 21 in the FIGS. 9 and 11 normally relaxed position of the shoe. FIG. 13 shows the shoe completely collapsed inwardly around the cam.

Figure 14:
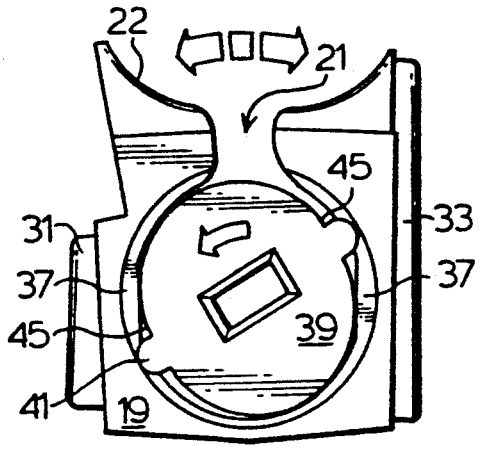
FIGS. 14 and 15 are further side views showing rotation of the cam within the shoe moving it from the FIG. 13 release to the FIG. 12 brake position.
Figure 15:
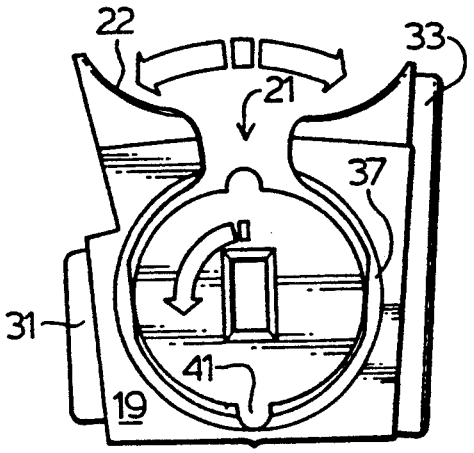

Another interesting feature of the present invention occurs as a result of the eliptical shaping of cam 39. This is again best seen having reference to FIG. 13 of the drawings where there is a noticeable clearance between the flats of the cam and the shoe and where this clearance gradually decreases to either side of the flat to flat alignment. The opening at the interior of the shoe other than at the flats 45 is circular in configuration. The exterior of the cam, other than at the flats, rather than being circular is slightly off round or eliptical in configuration. This results in a relatively gradual opening of the shoe with rotation of the cam as shown in FIGS. 14 and 15 of the drawings. In particular, in FIG. 14, the flats of the cam are only slightly out of alignment with the flats of the show resulting in initiation of the outward spreading of the shoe. In FIG. 15, the flats on the cam are at substantially right angles to the flats on the shoe exposing the flats on the shoe to the maximum diameter across the cam and flexing the shoe to its widest spread position, i.e. a wide spread position as shown in FIG. 14.

This gradual outward flexing of the shoe provides substantially less wear and tear and also makes it easier to flex the shoe than would be the case when working with a shoe which is completely rounded other than at its flats. A completely rounded cam other than at the flats would cause the shoe to immediately expand from a relaxed to a maximum spread position.

The bottom configuration of the shoe is also of interest. As opposed to an open top and as earlier described, the bottom is closed. As seen in FIGS. 12 through 15, the shoe has a center slightly thickened region 25 diametrically opposite opening 21. The bottom end of the shoe is symmetrical to either side of region 25 producing in effect two elongated lever arms 27 and 29. As the shoe is flexed outwardly, as best seen in FIGS. 12 and 15, the shoe bends at lever arms 27 and 29 so that in the maximum flexed condition, the shoe is essentially flat across its bottom end as opposed to the slightly triangular configuration shown in FIG. 13 of the drawings.

The provision of two effective elongated lever arms to either side of the center region of the bottom of the shoe again enhances outward flexing of the shoe.

The overall assembly except for the spring steel coil spring is preferably made from a nylon or nylon type plastic material. It is light in weight and substantially wear resistant.

Although various preferred embodiments of the invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A sash window balance assembly comprising a top opening balance shoe fitted within a window jamb channel having channel walls between which said shoe is trapped, a top opening in said shoe leading downwardly to a cam opening, a cam rotatably fitted in said cam opening, both said cam opening and said cam having small and large diameter regions, said shoe having outer brake pads to opposite sides thereof and being made of a flexible material which, when unstressed, by aligning the small diameter regions on said shoe and said cam with one another holds said shoe in a preset release position in which said shoe is movable along said window channel, said shoe being expandable from said preset release position to a brake position in which said brake pads engage said channel walls by rotating said cam such that said small diameter regions on said cam and said cam opening are out of alignment with one another, said brake pads being tapered upwardly along said shoe inwardly away from said channel walls whereby when said shoe is moved to said brake position and said shoe flexes outwardly from said top opening in said shoe, there is a flush contact at least substantially entirely along said brake pads with said channel walls, the small diameter region on said shoe being of a lesser diameter than the small diameter region of said cam opening whereby said shoe is additionally collapsible inwardly of said preset release position around said cam if subjected to interference in said window jamb channel.

2. A sash window balance assembly as claimed in claim 1, wherein said brake pads include rounded upper and lower edges.

3. A sash window balance assembly as claimed in claim 1, wherein said shoe has a closed base and comprises a pair of shoe arms flexibly connected to one another centrally of said base of said shoe, said shoe arms having substantially consistent flex to opposite sides of said shoe.

* * * * *